US005987295A

United States Patent [19]

Matsuo et al.

[11] Patent Number: 5,987,295

[45] Date of Patent: Nov. 16, 1999

[54] IMAGE FIXING APPARATUS AND IMAGE FIXING ROLLER HAVING A SHORTENED WARM-UP TIME

[75] Inventors: Minoru Matsuo, Sagamihara; Toshio Kobayashi, Atsugi; Yuichi Jibiki, Yokohama, all of Japan

[73] Assignee: Ricoh Company, Ltd., Tokyo, Japan

[21] Appl. No.: 09/061,260

[22] Filed: Apr. 17, 1998

[51] Int. Cl.[6] ..... G03G 15/20

[52] U.S. Cl. ..... 399/330; 399/331; 399/332; 399/333; 399/334; 399/335

[58] Field of Search ..... 399/330, 331, 399/332, 333, 334, 335; 219/216, 469, 470, 471; 492/46

[56] References Cited

U.S. PATENT DOCUMENTS 5,740,513 4/1998 Matsuo et al. .
5,773,793 6/1998 Matsuo .
5,804,794 9/1998 Matsuo et al. ..... 219/216

*Primary Examiner*—Richard Moses
*Assistant Examiner*—Shival Virmani
*Attorney, Agent, or Firm*—Oblon, Spivak, McClelland, Maier & Neustadt, P.C.

[57] ABSTRACT

An image fixing apparatus for thermally fixing images on an image receiving material at a predetermined image fixing temperature, comprising an image fixing device comprising a core member, and an exothermic phase transition layer provided on said core member, comprising an exothermic phase transition material which is capable of performing reversible phase transition from an amorphous solid state to a crystalline state with liberation of crystallization heat therefrom, and vice versa, and has a melting point higher than said predetermined image fixing temperature, a heating device which maintains the temperature of at least an outer surface of said image fixing device at said predetermined image fixing temperature, a first phase transition device which heats said exothermic phase transition layer, thereby having said exothermic phase transition material perform phase transition from said amorphous state to said crystalline state for liberation of crystallization heat therefrom, a second phase transition device which has said exothermic phase transition material perform phase transition from said crystalline state to said amorphous solid state and a pressure application device which rotates in pressure contact with the outer surface of said image fixing device with the application of a predetermined pressure thereto.

21 Claims, 8 Drawing Sheets

IMAGE FIXING APPARATUS AND IMAGE FIXING ROLLER HAVING A SHORTENED WARM-UP TIME

BACKGROUND OF THE INVENTION

1. Field of the Invention

The present invention relates to an image fixing apparatus for use in an electrophotographic copying machine, more particularly to an image fixing apparatus for thermally fixing toner images on a transfer sheet. The present invention also relates to an image fixing roller for use in the image fixing apparatus.

2. Discussion of Background

For example, in a conventional electrophotographic copying machine provided with a laser printer, a rotatable photoconductor drum is provided, and copies are made with the following steps: A photoconductive portion of the photoconductive drum is uniformly charged by a charging unit, and information is recorded in the form of latent electrostatic images by the application of a laser beam thereto by a laser scanning unit. The latent electrostatic images are then developed with toner to toner images by a development unit in the electrophotographic copying machine. The developed toner images are then transferred to a recording sheet. The toner-images-bearing recording sheet is then passed through a thermal image fixing apparatus, in which the toner images are thermally fixed to the recording sheet. Thus, copies are made by the conventional electrophotographic copying machine.

In the above-mentioned conventional thermal image fixing apparatus, for instance, an image fixing roller as illustrated in FIG. 10 is employed, which is composed of a hollow core cylinder 21 which is made of, for instance, aluminum, and a toner-releasing layer 22 which is made of, for instance, a fluoroplastic, and provided on the outer peripheral surface of the hollow core cylinder 21. The toner-releasing layer 22 is capable of preventing toner from adhering to the outer peripheral surface of the image fixing roller during the image fixing process, and releasing toner from the surface of the image fixing roller.

In the image fixing roller, a heater (not shown) such as a halogen lamp is provided in a vacant portion within the hollow core cylinder 21 along the revolution axis thereof, whereby the image fixing roller is heated from the inside thereof by the radiation heat from the heater.

In parallel with the image fixing roller, there is provided a pressure application roller (not shown) which comes into pressure contact with the peripheral surface of the image fixing roller. The image fixing roller and the pressure application roller are rotated in the same direction in the contact portion where the two rollers are mutually in pressure contact, and the toner-images-bearing recording sheet is transported so as to pass through the contact portion between the two rollers, whereby the toner images transferred to the recording sheet are softened by the heat from the image fixing roller and fixed to the recording sheet which is held between the two rollers, under the application of the pressure thereto by the pressure application roller.

In such a thermal image fixing apparatus, however, a relatively long warm-up time is required before the outer peripheral surface of the image fixing roller reaches a predetermined image fixing temperature required for toner image fixing after the thermal image fixing apparatus is powered.

Conventionally, in order to shorten the warm-up time, the main switch for the image fixing apparatus is designed in such a manner that when turned on, the preheating of the image fixing roller is started and continued. This method, however, has the shortcoming of wasting a significant amount of power.

Further, in order to avoid the above problem, there have been proposed, for example, the following various methods for shortening the worm-up time for such an image fixing roller:

A method of providing a resistive heat emitting layer at or near the peripheral surface of an image fixing roller (Japanese Laid-Open Patent Applications 55-164860, 56-138766 and 2-285383); a method of blackening the inner wall of a hollow portion of an image fixing roller to increase the radiant efficiency thereof, thereby increasing the heat absorption efficiency, and a method of increasing the surface area of the inner wall of a hollow portion of an image fixing roller by roughening the surface of the inner wall (Japanese Laid-Open Patent Applications 4-34483 and 4-134387); a method of constructing an image fixing roller composed of a heat pipe (Japanese Laid-Open Patent Application 3-139684); a method of heating an image fixing roller by electromagnetic induction (Japanese Patent Laid-Open Application 4-55055); a method of constructing an image fixing roller by use of an electroconductive elastic material and causing electric current to flow therethrough, thereby directly heating the image fixing roller (Japanese Laid-Open Patent Application 4-186270); and a method of constructing an image fixing roller which includes a cylindrical heater in which a positive thermistor material is used (Japanese Laid-Open Patent Application 4-42185).

In order to make the above-mentioned methods actually effective in practical use, it is required that the core roller for each of the image fixing rollers have good heat conductivity. However, there is a limitation to the reduction of the thickness of the core roller for increasing the heat conductivity in view of the mechanical strength required for the image fixing roller for use in practice. Therefore the above-mentioned methods are not always practical. Furthermore, a large amount of energy has to be applied to the heating elements such as heaters for the image fixing rollers in order to sufficiently shorten the warm-up time for such conventional image fixing rollers.

SUMMARY OF THE INVENTION

It is therefore a first object of the present invention to provide an image fixing apparatus comprising an image fixing roller, which is capable of sufficiently reducing the warm-up time for the image fixing roller for use in practice, without being restricted by the thermal conductivity of a core roller member for the image fixing roller.

A second object of the present invention is to provide the image fixing roller for use in the above-mentioned image fixing apparatus.

The first object of the present invention can be achieved by an image fixing apparatus comprising:

an image fixing roller for thermally fixing images on an image receiving material at a predetermined image fixing temperature, the image fixing roller comprising (a) a core roller member; and (b) an exothermic phase transition layer provided on the core roller member, comprising an exothermic phase transition material capable of performing reversible phase transition from an amorphous state to a crystalline state and vice versa, and crystallizing at a crystallization temperature which is lower than the predetermined image fixing temperature, with liberation of crystallization heat therefrom, and the exothermic phase transition material having a melting point higher than the predetermined image fixing temperature, thereby additionally increasing the temperature elevation rate before the temperature of the outer peripheral surface of the image fixing roller reaches the predetermined image fixing temperature;

heating means for heating the image fixing roller so as to have the outer peripheral surface thereof reach and maintain the predetermined image fixing temperature; first phase transition means for performing phase transition of the exothermic phase transition material from the amorphous state to the crystalline state by heating the exothermic phase transition layer for liberation of the crystallization heat therefrom;

second phase transition means for performing phase transition of the exothermic phase transition material from the crystalline state to the amorphous state via a melted state by cooling the exothermic phase transition layer for successive use of the crystallization heat thereafter by use of the first phase transition means; and a pressure application roller which is rotated in contact with the peripheral surface of the image fixing roller, with the application of a predetermined pressure to the image fixing roller.

In the above image fixing apparatus, it is preferable that the exothermic phase transition material for use in the exothermic phase transition layer comprise at least one component selected from the group consisting of a chalcogen and a chalcogenide.

The above exothermic phase transition material may further comprise at least one additional component selected from the group consisting of the elements of Groups IIIA through VIB of the Periodic Table except the chalcogen, and a compound comprising any of the elements of Groups IIIA through VIB of the Periodic Table except the chalcogenide.

Instead of the above additional component, the exothermic phase transition material may further comprise an exothermic polymeric material capable of performing reversible phase transition from an amorphous state to a crystalline state and vice versa, and crystallizing at a crystallization temperature which is lower than said predetermined image fixing temperature, with liberation of crystallization heat therefrom, and said exothermic phase transition material having a melting point higher than said predetermined image fixing temperature, thereby additionally increasing the temperature elevation rate before the temperature of the outer peripheral surface of said image fixing roller reaches said predetermined image fixing temperature.

Alternatively, in addition to the additional component, the exothermic phase transition material further comprises the above-mentioned exothermic polymeric material.

Alternatively, the exothermic phase transition material for use in the exothermic phase transition layer may be a polymeric material having the same function as that of the above-mentioned exothermic polymeric material.

Furthermore, in the image fixing apparatus of the present invention, there can be employed an exothermic phase transition material which comprises a chalcogen and at least one additional component selected from the group consisting of the elements of Groups IIIA through VIB of the Periodic Table except the chalcogen, and crystal nuclei with the number thereof per unit volume of the exothermic phase transition material being $10^6/cm^3$ or more.

In the image fixing apparatus of the present invention, the second phase transition means may comprise (a) melting means for melting the exothermic phase transition material which is in the crystalline state to change the crystalline state to the melted state, and (b) cooling means for cooling the exothermic phase transition material which is in the melted state to change the state to the amorphous state.

In the image fixing apparatus of the present invention, the image fixing roller may further comprise a protective layer which is provided on the exothermic phase transition layer and seals the opposite ends thereof.

Furthermore, in the image fixing apparatus of the present invention, the image fixing roller may be provided with a toner release layer on the outermost peripheral surface thereof.

The above toner release layer may also be used as a protective layer for protecting the image fixing roller.

The image fixing apparatus of the present invention can also be constructed so as to further comprise a protective layer for protecting the exothermic phase transition layer, which is provided on the exothermic phase transition layer, and wherein the exothermic phase transition material comprises a chalcogen and at least one additional component selected from the group consisting of the elements of Groups IIIA through VIB of the Periodic Table except the chalcogen, and crystal nuclei with the number thereof per unit volume of the exothermic phase transition material being $10^6/cm^3$ or more, and increasing in the direction of the thickness of the exothermic phase transition layer toward the protective layer.

In the image fixing apparatus of the present invention, the core roller member for the image fixing roller may comprise a resistive heating layer which serves as the heating means for heating the image fixing roller and also as the melting means for the second phase transition means, and the image fixing roller may further comprise an insulating layer between the resistive heating layer and the exothermic phase transition layer to avoid the electric connection between the resistive heating layer and the exothermic phase transition layer, when necessary.

Instead of the above mentioned resistive heating layer, a resistive heating member can also be employed. More specifically, the image fixing roller for the image fixing apparatus of the present invention can be constructed so as to further comprise:

a resistive heating member between the core roller member and the exothermic phase transition layer, the resistive heating layer serving as the heating means for heating the image fixing roller and also as the melting means for the second phase transition means, and an insulating layer between the exothermic phase transition layer and the resistive heating member.

In the image fixing apparatus of the present invention, the exothermic phase transition material which is in the melted state may be cooled by the cooling means for the second phase transition means as the image fixing roller is rotated.

It is preferable that in the image fixing apparatus of the present invention, the exothermic phase transition material which is in the melted state be cooled with the predetermined pressure applied to the peripheral surface of the image fixing roller by the pressure application roller being reduced.

A second object of the present invention can be achieved by an image fixing roller for thermally fixing images on an image receiving material at a predetermined image fixing temperature, comprising:

a core roller member; and an exothermic phase transition layer provided on the core roller member, comprising an exothermic phase transition material capable of performing reversible phase transition from an amorphous state to a crystalline state and vice versa, and crystallizing at a crystallization temperature which is lower than the predetermined image fixing temperature, with liberation of crystallization heat therefrom, and the exothermic phase transition material having a melting point higher than the predetermined image fixing temperature, thereby additionally increasing the temperature elevation rate before the temperature of the outer peripheral surface of the image fixing roller reaches the predetermined image fixing temperature.

In the above image fixing roller of the present invention, it is preferable that the exothermic phase transition material for use in the exothermic phase transition layer comprise at least one component selected from the group consisting of a chalcogen and a chalcogenide.

The above exothermic phase transition material may further comprise at least one additional component selected from the group consisting of the elements of Groups IIIA through VIB of the Periodic Table except the chalcogen, and a compound comprising any of the elements of Groups IIIA through VIB of the Periodic Table except the chalcogenide.

Instead of the above additional component, the exothermic phase transition material may further comprise an exothermic polymeric material capable of performing reversible phase transition from an amorphous state to a crystalline state and vice versa, and crystallizing at a crystallization temperature which is lower than said predetermined image fixing temperature, with liberation of crystallization heat therefrom, and said exothermic phase transition material having a melting point higher than said predetermined image fixing temperature, thereby additionally increasing the temperature elevation rate before the temperature of the outer peripheral surface of said image fixing roller reaches said predetermined image fixing temperature.

Alternatively, in addition to the additional component, the exothermic phase transition material further comprises the above-mentioned exothermic polymeric material.

Alternatively, the exothermic phase transition material for use in the exothermic phase transition layer may be a polymeric material having the same function as that of the above-mentioned exothermic polymeric material.

Furthermore, in the image fixing roller of the present invention, there can be employed an exothermic phase transition material which comprises a chalcogen and at least one additional component selected from the group consisting of the elements of Groups IIIA through VIB of the Periodic Table except the chalcogen, and crystal nuclei with the number thereof per unit volume of the exothermic phase transition material being $10^6/cm^3$ or more.

The image fixing roller of the present invention may further comprises a protective layer which is provided on the exothermic phase transition layer and seals the opposite ends thereof.

The image fixing roller of the present invention may further comprise a toner release layer which is provided on the outermost peripheral surface of the image fixing roller.

The above toner release layer may also be used as a protective layer for protecting the image fixing roller.

The image fixing roller of the present invention can also be constructed so as to further comprise a protective layer for protecting the exothermic phase transition layer, which is provided on the exothermic phase transition layer, and wherein the exothermic phase transition material comprises a chalcogen and at least one additional component selected from the group consisting of the elements of Groups IIIA through VIB of the Periodic Table except the chalcogen, and crystal nuclei with the number thereof per unit volume of the exothermic phase transition material being $10^6/cm^3$ or more, and increasing in the direction of the thickness of the exothermic phase transition layer toward the protective layer.

In the image fixing roller of the present invention, the core roller member may be constructed so as to comprise a resistive heating layer for heating the image fixing roller and for maintaining the predetermined image fixing temperature, and also for melting the exothermic phase material to its melting point, and further so as to comprise an insulating layer between the resistive heating layer and the exothermic phase transition layer to avoid the electric connection between the resistive heating layer and the exothermic phase transition layer, when necessary.

Instead of the above-mentioned resistive heating layer, a resistive heating member can also be employed. More specifically, the image fixing roller of the present invention can be constructed so as to further comprise:

a resistive heating member between the core roller member and the exothermic phase transition layer, the resistive heating layer being for heating the image fixing roller and for maintaining the predetermined image fixing temperature, and also for melting the exothermic phase material to its melting point, and an insulating layer between the exothermic phase transition layer and the resistive heating member, to avoid the electric connection between the resistive heating member and the exothermic phase transition layer, when necessary.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

An image fixing apparatus of the present invention comprises:

an image fixing roller for thermally fixing images on an image receiving material at a predetermined image fixing temperature, the image fixing roller comprising (a) a core roller member; and (b) an exothermic phase transition layer provided on the core roller member, comprising an exothermic phase transition material capable of performing reversible phase transition from an amorphous state to a crystalline state and vice versa, and crystallizing at a crystallization temperature which is lower than the predetermined image fixing temperature, with liberation of crystallization heat therefrom, and the exothermic phase transition material having a melting point higher than the predetermined image fixing temperature, thereby additionally increasing the temperature elevation rate before the temperature of the outer peripheral surface of the image fixing roller reaches the predetermined image fixing temperature;

heating means for heating the image fixing roller so as to have the outer peripheral surface thereof reach and maintain the predetermined image fixing temperature;

first phase transition means for performing phase transition of the exothermic phase transition material from the amorphous state to the crystalline state by heating the exothermic phase transition layer for liberation of the crystallization heat therefrom;

second phase transition means for performing phase transition of the exothermic phase transition material from the crystalline state to the amorphous state via a melted state by cooling the exothermic phase transition layer for successive use of the crystallization heat thereafter by use of the first phase transition means; and a pressure application roller which is rotated in contact with the peripheral surface of the image fixing roller, with the application of a predetermined pressure to the image fixing roller.

More specifically, the above image fixing apparatus will now be explained with reference to FIG. 1 which shows a schematic diagram of an electrophotographic copying machine.

Figure 1:
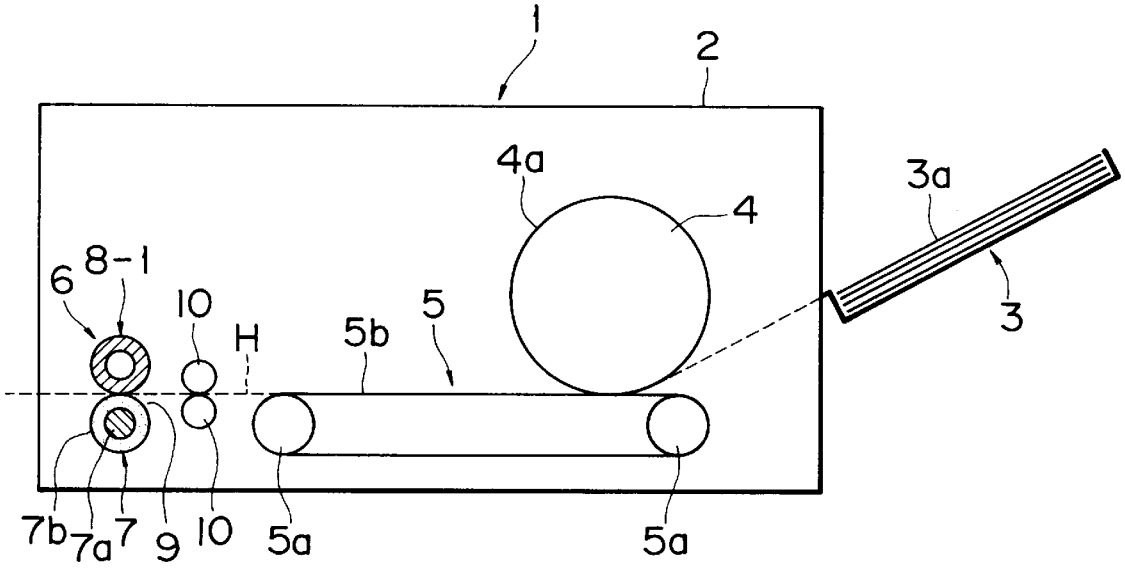
FIG. 1 is a schematic diagram of an electrophotographic copying machine in which an image fixing apparatus and an image fixing roller of the present invention can be incorporated.

In FIG. 1, reference numeral 1 indicates an electrophotographic copying machine; reference numeral 2, an outer cover for the electrophotographic copying machine 1; reference numeral 3, a recording sheet feed unit; reference numeral 4, a photoconductor comprising a photoconductive layer 4*a* on the surface thereof; reference numeral 5, an image transfer unit; and reference numeral 6, the image fixing apparatus of the present invention.

The image transfer unit 5 comprises a pair of recording sheet transportation rollers 5*a*, an endless belt 5*b* trained over the transportation rollers 5*a* and a bias roller (not shown).

Recording sheets 3*a* stacked in the recording sheet feed unit 3 are successively fed therefrom toward the photoconductor 4 with a predetermined timing by a sheet feed roller (not shown).

Toner images are formed on the surface of the photoconductive layer 4*a* and transferred onto the recording sheet 3*a*. The recording sheet 3*a* which bears the toner images thereon is then transported to the image fixing apparatus 6 along the path shown by the broken line H in FIG. 1.

The image fixing apparatus 6 comprises a pressure application roller 7 and an image fixing roller 8-1, which is an image fixing roller of the present invention. The pressure application roller 7 is in pressure contact with the image fixing roller 8-1, so that the image fixing roller 8-1 is driven in rotation by the rotation of the pressure application roller 7.

Near the image fixing apparatus 6, there is provided a pair of auxiliary rollers 10 for guiding the recording sheet 3*a* toward the nip between the pressure application roller 7 and the image fixing roller 8-1.

As the pressure application roller 7, there can be employed a conventional pressure application roller which comprises a core metal roller 7*a* made of, for example, aluminum or iron, and an elastic layer 7*b* made of, for example, rubber, which covers the entire peripheral surface of the core metal roller 7*a*.

As mentioned previously, the image fixing roller of the present invention comprises (a) a core roller member; and (b) an exothermic phase transition layer comprising an exothermic phase transition material capable of performing reversible phase transition from an amorphous state to a crystalline state and vice versa, and crystallizing at a crystallization temperature which is lower than the predetermined image fixing temperature, with liberation of crystallization heat therefrom, and the exothermic phase transition material having a melting point higher than the predetermined image fixing temperature, thereby additionally increasing the temperature elevation rate before the temperature of the outer peripheral surface of the image fixing roller reaches the predetermined image fixing temperature.

Figure 2:
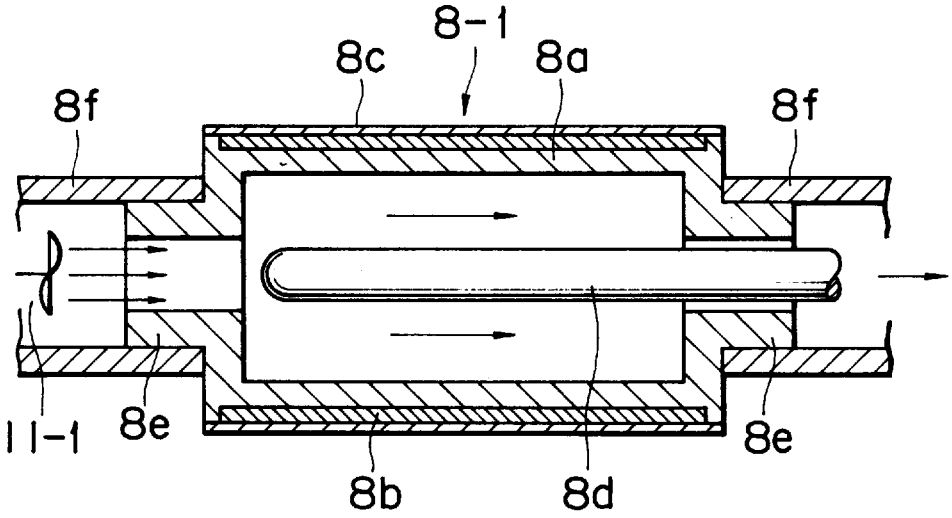
FIG. 2 is a schematic cross-sectional view of an example of an image fixing roller of the present invention.

FIG. 2 schematically shows a cross-sectional view of the image fixing roller 8-1 for use in the image fixing apparatus 6 according to the present invention.

As the core roller member for use in the image fixing roller 8-1, for example, there can be a hollow cylindrical core metal 8*a* as illustrated in FIG. 2. As the material for the hollow cylindrical core metal 8*a*, conventionally employed materials with excellent thermal conductivity such as aluminum, aluminum alloys, and SUS, can be employed, but are not limited to such particular materials since the material for the core roller member is not restricted by the thermal conductivity thereof in the present invention.

On the outer peripheral surface of the hollow cylindrical core metal 8*a*, there is provided an exothermic phase transition layer 8*b*, which comprises the previously mentioned exothermic phase transition material.

In the present invention, it is required that the exothermic phase transition material be capable of performing reversible phase transition from an amorphous state to a crystalline state and vice versa, and crystallize at a crystallization temperature which is lower than the predetermined image fixing temperature, with liberation of crystallization heat therefrom, and that the exothermic phase transition material have a melting point higher than the predetermined image fixing temperature, in order to additionally increase the temperature elevation rate before the temperature of the outer peripheral surface of the image fixing roller reaches the predetermined image fixing temperature.

Currently the image fixing temperature is generally in the range of 180 to 200° C., so that in the case where the image fixing temperature is in the range of 180 to 200° C., it is preferable that the exothermic phase transition material crystallize at a temperature, for instance, in the range of 80° C. to 180° C., and that the exothermic phase transition material have a melting point higher than 200° C.

It is also preferable that the exothermic phase transition material be capable of repeatedly and easily performing reversible phase transition from an amorphous state to a crystalline state and vice versa, with liberation of crystallization heat at the crystallization temperature.

Examples of the exothermic phase transition material for use in the exothermic phase transition layer 8*b* are materials comprising a chalcogen such as O, S, Se or Te, or a chalcogenide.

Specific examples of the chalcogenide are alloys such as Si—S, Si—S—Sb, Si—Se—As, Si—Se—Sb, Si—Te, Si—Te—P, Si—Te—As, Si—As—Te, Si—Ge—As—Te, Si—Ge—As—Te, Ge—S, Ge—S—In, Ge—S—P, Ge—S—As, Ge—Se, Ge—Se—Tl, Ge—Se—P, Ge—Se—As, Ge—Se—Sb, Ge—Te—P, Ge—Te—As, Ge—As—Te, Ge—P—S, Ge—S, Ge—Sb—Se, Ge—As—Se, Ge—P—S, As—S—Se, As—S—Tl, As—S—Sb, As—S—Te, As—S—Br, As—S—I, As—S—Bi, As—S—Ge, As—S—Se—Te, As—Sb—Tl—S—Se—Te, As—Sb—P—S—Se—Te, As—Se—Cu, As—Se—Ag, As—Se—Au, As—Se—Zn, As—Se—Cd, As—Se—Hg, As—Se—Ga, As—Se—B, As—Se—Tl, As—Se—P, As—Se—Sb, As—Se—Te, As—Se—I, As—Se—In, As—Se—Sn, As—Se—Pb, As—Se—Ge, As—Se—Bi, As—Te—Tl, As—Te—I, As—Te—Ge, Sb—S, and C—S; oxides such as $SeO_2$; sulfides containing any of B, Ga, In, Ge, Sn, N, P, As, Sb, Bi, O, or Se; selenium compounds containing any of Tl, Si, Sn, Pb, P, As, Sb, Bi, O, Se, or Te; and tellurium compounds containing any of Tl, Sn, Pb, Sn, Bi, O, Se, As, or Ge.

The above-mentioned chalcogens and chalcogenides may also be used in combination.

Of the above-mentioned chalcogens and chalcogenide alloys, selenium and selenium-tellurium alloys are particularly preferable for use in the present invention. This is because selenium and selenium-tellurium alloys become amorphous from a melted state when cooled; and crystallize, with conspicuous and rapid liberation of crystallization heat, when heated up to a crystallization temperature in the range of 80 to 200° C.

The exothermic phase transition layer 8*a* may further comprise at least one additional component selected from the group consisting of the elements of Groups IIIA through VIB of the Periodic Table except the chalcogent and a compound comprising any of the elements of Groups IIIA through VIB of the Periodic Table except the chalcogenide.

Specific examples of such an additional component are alloys such as Ge—As; oxides such as $P_2O_5$, $B_2O_3$, $As_2O_3$, $SiO_2$, $GeO_2$, $In_2O_3$, $Tl_2O_3$, $SnO_2$, $PbO_2$, $K_2B_4O_7NaPO_3$, $Na_2Si_2O_5$, $PbSiO_3$; and halogenides such as $BeF_2AlF_3$, $ZnCl_2$, AgCl, AgBr, AgI, $PbCl_2$, and $PbI_2$.

The exothermic phase transition material for use in the exothermic phase transition layer may also be a polymeric material capable of repeatedly and easily performing reversible phase transition from an amorphous state to a crystalline state and vice versa, with liberation of crystallization heat at the crystallization temperature.

The exothermic phase transition material for use in the exothermic phase transition layer may also comprise the above-mentioned exothermic polymeric material and the previously mentioned chalcogen or chalcogenide, optionally with further addition of at least one component selected from the group consisting of the elements of Groups IIIA through VIB of the Periodic Table except the chalcogen, and a compound comprising any of the elements of Groups IIIA through VIB of the Periodic Table except the chalcogenide.

Specific examples of the exothermic polymeric material for use in the exothermic phase transition layer in the present invention are polyethylene, polypropylene, polybutene, polyvinylidene fluoride, polyoxymethylene, polyoxyethylene, polyoxytetramethylene, polyoxyteramethylene, polyoxybischloromethyltrimethylene, polyethylene diadipate, polyethylene terephthalate, nylon-6, nylon-7, nylon-8, nylon-10, nylon-11, nylon-12, nylon-66, nylon-77, nylon-610, polybutylene terephthalate, polychlorotrifluoroethylene, polyvinyl alcohol, polyvinyl fluoride, polyvinylidene chloride, polychloroprene, polyethylene oxide, polytrifluorochloroethylene, polyvinyl methyl ether, polyacetal, polyphenylene sulfide, polyether ether ketone, thermoplastic fluoroplastics, aromatic polyester, polyisotactic butadiene, and polyteremethylene terephthalate.

In the image fixing apparatus of the present invention, the image fixing roller may further comprise a protective layer which is provided on the exothermic phase transition layer and seals the opposite ends thereof.

To be more specific, with reference to FIG. 2, a protective layer 8*c* made of, for example, fluoroplastic, is provided on the outer peripheral surface of the exothermic phase transition layer 8*b* and seals the opposite ends of the exothermic phase transition layer 8*b*, so that even when the exothermic phase transition material in the exothermic phase transition layer 8*b* is melted, the exothermic phase transition material is prevented from flowing out of the exothermic phase transition layer 8*b*.

The protective layer 8*c* may be composed of a material such as fluoroplastic, which prevents toner from adhering to the protective layer 8*c*. In this case, the protective layer 8*c* can also be used as a toner releasing layer.

Instead of the protective layer 8*c*, a toner releasing layer may be provided, which also may function as the above-mentioned protective layer.

Alternatively, as such a protective layer or a toner releasing layer, a heat-shrinkable tube made of, for example, tetrafluoroethylene-perfluoroalkylvinyl ether copolymer (PFA resin), may also be used so as to cover the exothermic phase transition layer 8*b*, with application of heat to the heat-shrinkable tube.

In the image fixing roller 8-1 shown in FIG. 2, a halogen lamp 8d is provided within the hollow cylindrical core metal 8*a* as heating means for heating the image fixing roller 8-1 so as to have the outer peripheral surface thereof reach and maintain the predetermined image fixing temperature.

The halogen lamp 8*d* also has the function of heating the exothermic phase transition layer 8*b* to perform phase transition of the exothermic phase transition material from the amorphous state to the crystalline state for liberation of the crystallization heat therefrom; and has the function of heating the exothermic phase transition material to change the crystalline phase of the exothermic phase transition material to a melted state.

On each of the opposite ends of the image fixing roller 8-1, there is formed an axial end portion 8*e*. Furthermore, a cylindrical support portion 8*f* is mounted on each of the axial end portion 8*e* in such a manner that the axial end portion 8*e* is rotatable on the cylindrical support portion 8*f*.

As shown in FIG. 2, inside the cylindrical support portion 8*f*, there is provided an air fan 11-1 as cooling means for rapidly cooling the exothermic phase transition layer 8*b* when performing the phase transition of the exothermic phase transition layer 8*b* from the crystalline state to the amorphous state via the melted state.

The pair of the cylindrical support portions 8*f* serves as the path for guiding cool air through the inside of the image fixing roller 8-1, whereby the exothermic phase transition layer 8*b* is efficiently cooled for the phase transition thereof from the crystalline state to the amorphous state via the melted state.

Figure 3:
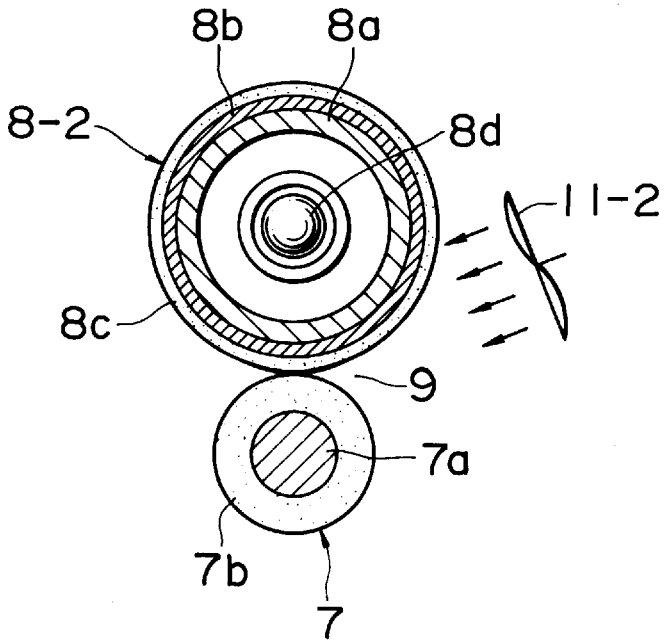
FIG. 3 is a schematic cross-sectional view of another example of an image fixing roller of the present invention.

FIG. 3 schematically shows another image fixing roller 8-2 for use in the image fixing apparatus of the present invention. The image fixing roller 8-2 is the same as the image fixing roller 8-1 shown in FIG. 2 except that cool air is not passed through the inside of the image fixing roller 8-2, but is directly blown against the outer peripheral surface of the image fixing roller 8-2 to cool the exothermic phase transition layer 8*b* by the cool air from an air fan 11-2 which is disposed outside, whereby the phase transition thereof from the crystalline state to the amorphous state is performed via the melted state.

In the above image fixing apparatus, in order to minimize the deformation of the exothermic phase transition layer 8*b* which is in indirectly pressure contact with the pressure application roller 7 during the cooling of the exothermic phase transition layer 8*b*, it is preferable that the cool air be blown against the nip 9 between the image fixing roller 8-2 and the pressure application roller 7 while the image fixing roller 8-2 and the pressure application roller 7 are rotated.

Furthermore, it is more preferable to reduce the pressure applied between the exothermic phase transition layer 8*b* and the pressure application roller 7 during the above-mentioned cooling of the exothermic phase transition layer 8*b* for preventing the deformation of the exothermic phase transition layer 8*b*.

In an image fixing roller comprising the core roller member and the previously mentioned exothermic phase transition layer provided on the core roller member for use in the present invention, the core roller member itself may be a resistive heating element which is capable of emitting heat when energized by causing an electric current to flow through the core roller member, and serves as the heating means for heating the image fixing roller and also as the melting means for the second phase transition means, optionally with the provision of an insulating layer between the core roller member and the exothermic phase transition layer in order to avoid the electric connection between the core roller member and the exothermic phase transition layer when necessary.

Alternatively, in the image fixing apparatus of the present invention, the core roller member for the image fixing roller may comprise a resistive heating layer having the same functions as those of the above-mentioned resistive heating element, namely, which serves as the heating means for heating the image fixing roller and also as the melting means for the second phase transition means, and the image fixing roller may further comprise an insulating layer between the resistive heating layer and the exothermic phase transition layer to avoid the electric connection between the resistive heating layer and the exothermic phase transition layer, when necessary.

Instead of the above mentioned resistive heating layer, a resistive heating member can also be employed. More specifically, the image fixing roller for the image fixing apparatus of the present invention can be constructed so as to further comprise:

a resistive heating member between the core roller member and the exothermic phase transition layer, the resistive heating layer serving as the heating means for heating the image fixing roller and also as the melting means for the second phase transition means, and an insulating layer between the exothermic phase transition layer and the resistive heating member.

Figure 4:
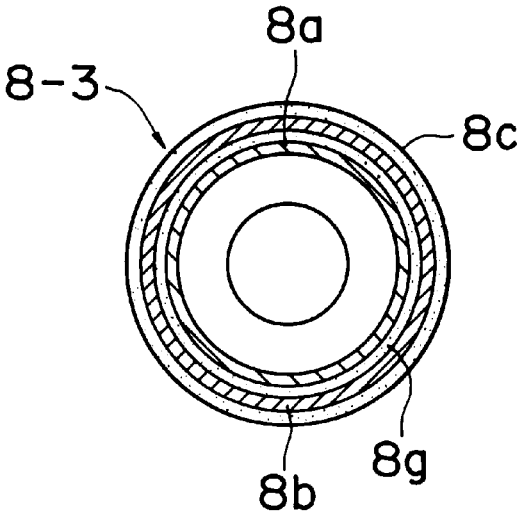
FIG. 4 is a schematic cross-sectional view of a further example of an image fixing roller of the present invention.

FIG. 4 is a schematic cross-sectional view of a further example of the image fixing roller for use in the image fixing apparatus, which is referred to as the image fixing roller 8-3.

In the image fixing roller 8-3, the hollow cylindrical core metal 8*a* serving as the core roller member itself is a resistive heating element having the previously mentioned functions, for instance, a Peltier effect type device, and an insulating layer 8*g* is interposed between the hollow cylindrical core metal 8*a* and the exothermic phase transition layer 8*b*.

When the Peltier effect type device is employed as mentioned above, the exothermic phase transition layer 8*b* can also be cooled by reversing the direction of the flow of the electric current for energizing the Peltier effect type device.

Figure 5:
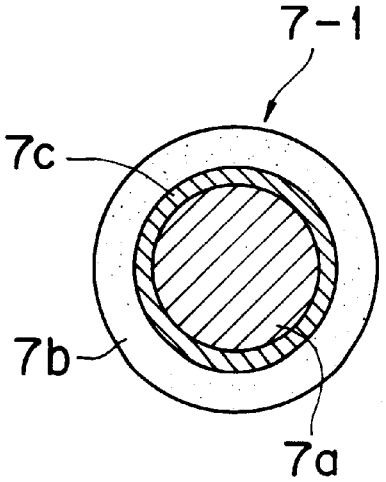
FIG. 5 is a schematic cross-sectional view of a pressure application roller for use in the image fixing apparatus of the present invention.

FIG. 5 is a schematic cross-sectional view of a pressure application roller 7-1 which also serves as a cooling roller by use of the above-mentioned Peltier effect type device for cooling the exothermic phase transition layer 8*b* which is in a melted state to change the state to an amorphous state.

More specifically, in this pressure application roller 7-1, a Peltier effect type device 7*c* is provided between a core metal 7*a* and an elastic layer 7*b* which covers the core metal 7*a* as illustrated in FIG. 5.

When the pressure application roller 7-1 is brought into pressure contact with the surface of the image fixing roller 8-3, for instance, and the Peltier effect type device 7*c* is energized so as to cool the pressure application roller 7-1, the exothermic phase transition layer 8*b* is cooled, while the pressure applied to the exothermic phase transition layer 8*b* by the pressure application roller 7-1 is appropriately adjusted so as to maintain the thickness of the exothermic phase transition layer 8*b* appropriately even if the exothermic phase transition layer 8*b* is heated and softened.

As mentioned previously, in the image fixing apparatus of the present invention, there can be employed an exothermic phase transition material which comprises a chalcogen and at least one additional component selected from the group consisting of the elements of Groups IIIA through VIB of the Periodic Table except the chalcogen, and crystal nuclei with the number thereof per unit volume of the exothermic phase transition material being $10^6/cm^3$ or more.

An exothermic phase transition layer comprising the above-mentioned exothermic phase transition material can be prepared, for example, by melting selenium with high purity (99.999%) and tellurium to prepare a SeTe alloy with the concentration of tellurium being 5 wt. % or more; or by melting a mixture of $SeO_2$ and selenium with high purity (99.999%) with application of heat thereto to prepare a selenium solid solution with the amount of dissolved oxygen therein being 1 ppm or more, and depositing the thus prepared SeTe alloy or Se solid solution in vacuum on the core roller member.

In the image fixing roller of the present invention, as mentioned previously, when the exothermic phase transition layer is heated and the state of the exothermic phase transition material therein is changed from an amorphous state to a crystalline state, crystallization heat is liberated from the exothermic phase transition material, so that the exothermic phase transition layer is rapidly heated and therefore the surface of the image fixing roller speedily reaches the image fixing temperature. Thus, the warm-up time for the image fixing roller can be sufficiently shortened.

After the image fixing temperature is reached, the surface temperature of the image fixing roller is controlled by heating means for heating the image fixing roller.

When the exothermic phase transition material in the exothermic phase transition layer has been crystallized, the heat conductivity of the exothermic phase transition layer is increased, so that the control of the image fixing temperature is further facilitated.

When a series of copying processes have been finished, the exothermic phase transition material in the exothermic phase transition layer is temporarily heated to a temperature above the melting point thereof and is then cooled or allowed to stand to be cooled, whereby the exothermic phase transition material changes its phase back to the initial amorphous phase so as to be ready to liberate crystallization heat therefrom in the next step when heated to its crystallization temperature.

The crystallization heat is liberated by the crystallization of the amorphous exothermic phase transition material, so that the liberation of heat of solidification at the melting point of the exothermic phase transition material is prevented and the liberation of the accumulated internal energy is utilized at the elevation of the temperature thereof.

Therefore, it is preferable that the exothermic phase transition material have great heat of fusion, and perform clear-cut and complete phase transition between an amorphous state and a crystalline state. Furthermore, it is preferable that the exothermic phase transition material have high crystallization rate because if the crystallization rate is low and therefore the heat liberation rate is low, the temperature of the surface of the image fixing roller cannot be rapidly elevated with high efficiency due to the diffusion of heat.

Generally, the crystallization rate of an amorphous material by the elevation of the temperature thereof depends upon the product of the number of crystal nuclei per unit volume of the amorphous material (crystal nucleus concentration) and the growth rate of crystal thereof at the interfaces of crystallites thereof.

The growth rate of crystal is a specific characteristic of each material and therefore cannot be controlled as desired, but the crystal nucleus concentration can be controlled by forming specific cites such as structural strain in the material or by containing foreign molecules such as impurities serving as crystal nuclei in the material.

The exothermic phase transition material, which comprises a chalcogen and at least one additional component selected from the group consisting of the elements of Groups IIIA through VIB of the Periodic Table except the chalcogen, and crystal nuclei with the number thereof per unit volume of the exothermic phase transition material being $10^6/cm^3$ or more, has sufficiently great heat of fusing, and can perform complete phase transition between an amorphous sate and a crystalline state, with high crystallization rate, and therefore can efficiently and rapidly elevate the temperature of the surface of the image fixing temperature.

Furthermore, for use in practice, it is preferable that the exothermic phase transition layer for use in the present invention have a glass transition temperature (Tg) above room temperature, and a melting point which is above the image fixing temperature, but is as close to the image fixing temperature as possible, and do not change its properties during the repeated crystallization and melting operations.

In this sense, an exothermic phase transition layer comprising as the main component selenium or a selenium-tellurium alloy is particularly preferable since such an exotheroic phase transition layer has the above-mentioned properties.

A particularly suitable substance for forming crystal nucleus for selenium is oxygen. This is because oxygen can form a solid solution with selenium in any ratio, and can be bonded to chains of selenium atoms at any position thereof, and has a different electronegativity from that of selenium, which is considered to be caused by a different atomic radius from that of selenium, a spatial strain and a different bonding force between oxygen and selenium, so that the rearrangement of the oxygen and selenium atoms in the alloy during the recrystallization thereof can be facilitated.

It is further preferable that the image fixing roller for use in the present invention comprise a protective layer for protecting the exothermic phase transition layer, which is provided on the exothermic phase transition layer, and wherein the exothermic phase transition material comprises a chalcogen and at least one additional component selected from the group consisting of the elements of Groups IIIA through VIB of the Periodic Table except the chalcogen, and crystal nuclei with the number thereof per unit volume of the exothermic phase transition material being $10^6/cm^3$ or more, and increasing in the direction of the thickness of the exothermic phase transition layer toward the protective layer.

By increasing the number of the crystal nuclei per unit volume of the exothermic phase transition material in the direction of the thickness of the exothermic phase transition layer toward the protective layer, crystallization heat is liberated more speedily near the protective layer so that the crystallization heat liberated from the exothermic phase transition layer is transmitted more speedily to the surface of the image fixing roller.

For instance, when the exothermic phase transition layer comprises a SeTe alloy with the content of Te being 5 wt. % or more, the concentration of Te is increased toward the protective layer to increase the number of crystal nuclei near the protective layer.

The features of this invention will become apparent in the course of the following description of exemplary embodiments which are given for illustration of the invention and are not intended to be limiting thereof.

EXAMPLE 1

Figure 7:
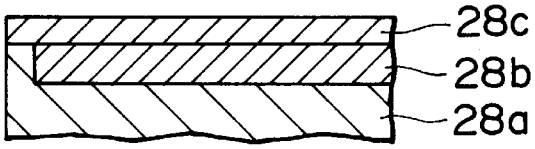

There was formed a double cylindrical core roller member 18*a* which was made of aluminum as shown in FIG. 7, with an outer diameter of 40 mm, including an inner cylindrical vacant portion corresponding to a portion with reference number 18*b*.

A fused selenium was injected into the inner cylindrical vacant portion, and the inner cylindrical portion was sealed, whereby an exothermic phase transition layer 18*b* composed of selenium, serving as an exothermic phase transition material, was formed.

A commercially available fluoroplastic resin (Trademark "857-305" made by DuPont de Nemours, E.I., Co.) was then sprayed onto the outer peripheral surface of the double cylindrical core roller member 18*a* and sintered at 380° C., whereby a toner releasing layer 18*c* with a thickness of about 20 μm was provided on the outer peripheral surface of the double cylindrical core roller member 18*a*.

Figure 6:
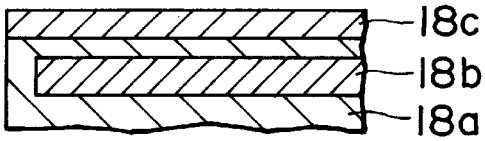
FIGS. 6 to 9 are schematic, partial cross-sectional views of image fixing rollers of the present invention.

Thus, an image fixing roller No. 1 of the present invention as shown in FIG. 6 was fabricated.

EXAMPLE 2

An outer peripheral portion with a depth of 0.1 mm was uniformly cut off a cylindrical core roller member made of aluminum with an outer diameter of 40 mm, with the opposite end portions with a length of about 5 mm near the opposite bearings therefor being remained and uncut, as shown in FIG. 7, whereby a cylindrical core roller member 28*a* was made.

With the opposite end portions being masked, a selenium-tellurium alloy with a tellurium content of 8 wt. % was deposited in vacuum with a thickness of 0.1 mm on the cut outer peripheral surface of the cylindrical core roller member 28*a*, whereby an exothermic phase transition layer 28*b* composed of the selenium-tellurium alloy serving as an exothermic phase transition material was formed, with the same level as that of each of the opposite end portions of the cylindrical core roller member 28*a*.

The cylindrical core roller member 28 was then covered with a heat-shrinkable tube made of electroconductive PFA resin and heated to 300° C., whereby a toner releasing layer 28*c* with a thickness of about 20 μm was formed on the cylindrical core roller member 28.

Thus, an image fixing roller No. 2 of the present invention as shown in FIG. 7 was fabricated.

EXAMPLE 3

Figure 8:
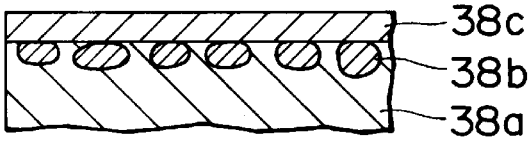

With reference to FIG. 8, an outer peripheral surface of a cylindrical core roller made of aluminum with an outer diameter of 40 mm was subjected to chemical etching, whereby a rough surface with undulations of about 0.05 mm was formed. On this rough surface of the cylindrical core roller member 38*a*, a selenium-tellurium alloy with a tellurium content of 30 wt. % was deposited in vacuum with a thickness of 0.06 mm, and the selenium-tellurium alloy deposited surface was abraded to make the surface smooth in such a manner that the aluminum-exposed surface ratio was about 40%, whereby an exothermic phase transition layer 38*b* composed of the selenium-tellurium alloy serving as an exothermic phase transition material was formed.

On the exothermic phase transition layer 38*b*, finely-divided particles of a commercially available electroconductive fluoroplastic resin (Trademark "MP611" made by Du Pont-Mitsui Fluorochemcials Co., Ltd.) were electrostatically deposited and then sintered at 380° C., whereby a toner releasing layer 38*c* with a thickness of about 20 μm was formed.

Thus, an image fixing roller No. 3 of the present invention as shown in FIG. 8 was fabricated.

EXAMPLE 4

Figure 9:
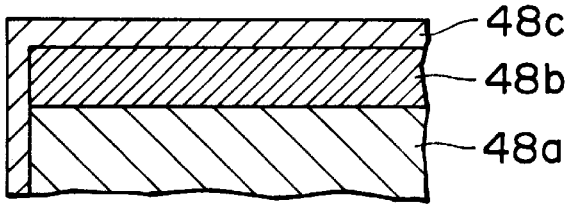

With reference to FIG. 9, on an outer peripheral surface of a cylindrical core roller 48*a* made of stainless steel with an outer diameter of 40 mm, a mixture of finely-divided particles of a commercially available electroconductive fluoroplastic resin (Trademark "MP611" made by Du Pont-Mitsui Fluorochemcials Co., Ltd.) and finely-divided particles of selenium with a content of 50 wt. % was electrostatically deposited and then sintered at 250° C., whereby an exothermic phase transition layer 48*b* was formed.

This cylindrical core roller with the exothermic phase transition layer 48*b* was then covered with a heat-shrinkable tube made of electroconductive PFA resin and heated to 300° C., whereby a toner releasing layer 48*c* with a thickness of 10 μm was formed on the exothermic phase transition layer 48*b*.

Thus, an image fixing roller No. 4 of the present invention as shown in FIG. 9 was fabricated.

Comparative Example 1

Figure 10:
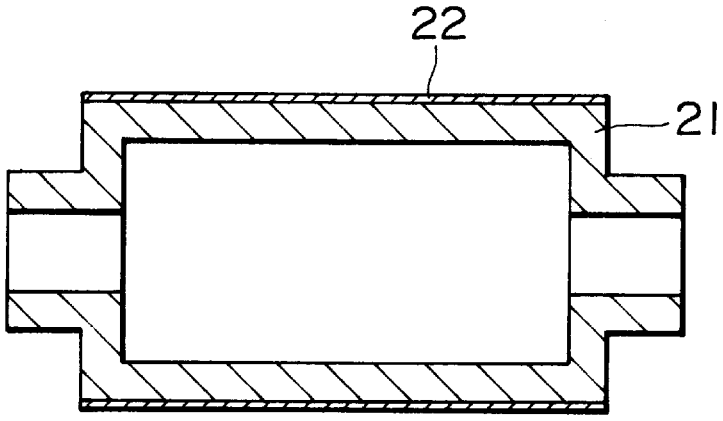
FIG. 10 is a schematic cross-sectional view of a conventional image fixing roller.

With reference to FIG. 10, an inner side of a cylindrical core roller 21 made of aluminum with an outer diameter of 40 mm was coated with a black paint comprising graphite for blackening treatment.

On the outer surface of the cylindrical core roller member 21, finely-divided particles of a commercially available electroconductive fluoroplastic resin (Trademark "MP611" made by Du Pont-Mitsui Fluorochemcials Co., Ltd.) were electrostatically deposited and then sintered at 380° C., whereby a toner releasing layer 22 with a thickness of 20 μm was formed.

Thus, a comparative image fixing roller No. 1 of a conventional type as shown in FIG. 10 was fabricated.

Each of the thus fabricated image fixing rollers Nos. 1 to 4 of the present invention and comparative image fixing roller No. 1 was incorporated into the image fixing apparatus of a commercially available electrophotographic copying machine (Trademark "M210" made by Ricoh Company, Ltd.), and the elevation of the temperature of the surface of each of the image fixing rollers was measured while each image fixing roller was heated with a heater with a power of 960 W.

Figure 11:
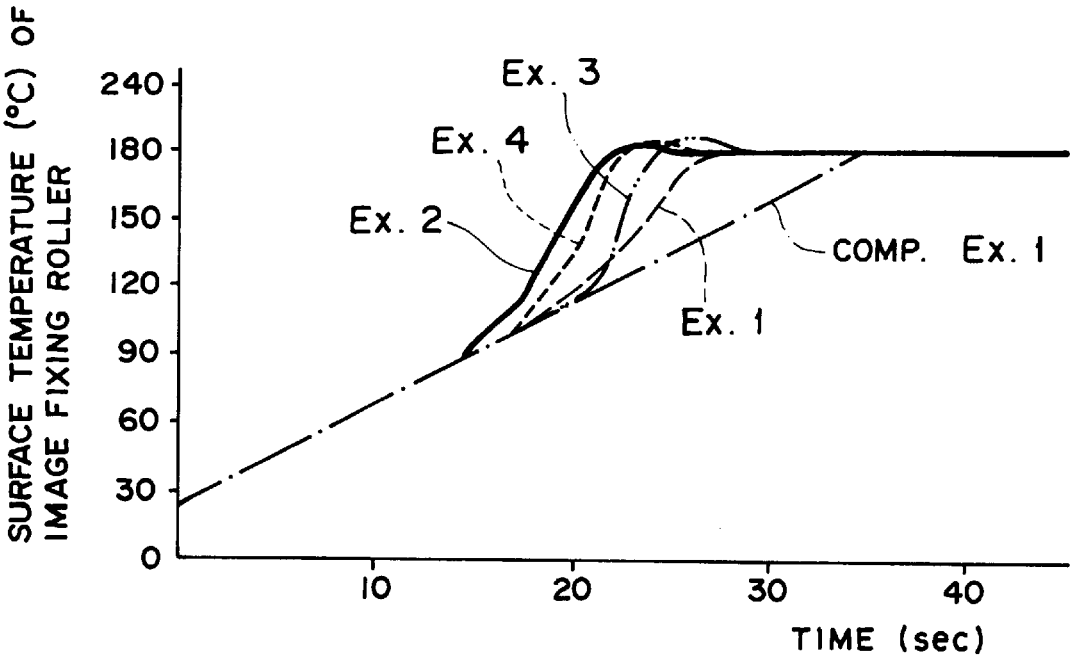
FIG. 11 is a graph showing the relationship between the warm-up time of each of image fixing rollers of the present invention and the surface temperature thereof, in comparison with the warm-up time of a comparative image fixing roller.

The results are shown in FIG. 11, which indicates that the warm-up time of any of the image fixing rollers of the present invention is significantly shortened in comparison with the warm-up time of the comparative image fixing roller No. 1.

The power applied to the heater for each image fixing roller was increased by 40% and cut off when the surface temperature reached 250° C. 30 minutes after that, the above-mentioned tests were repeated. The results were exactly the same as shown in FIG. 11.

Differential Thermal Analysis of Exothermic Phase Transition Material

In order to further specifically investigate the exothermic effect of the selenium-tellurium alloy with a tellurium content of 8 wt. % employed in the exothermic phase transition layer 28*b* in Example 2, the selenium-tellurium alloy was subjected to a differential thermal analysis.

More specifically, 50 mg of the selenium-tellurium alloy with a tellurium content of 8 wt. % was set in a commercially available differential thermal analyzer (Trademark "DT-30B" made by Shimadzu Corporation) with a temperature elevation rate of 10° C./min.

Figure 12:
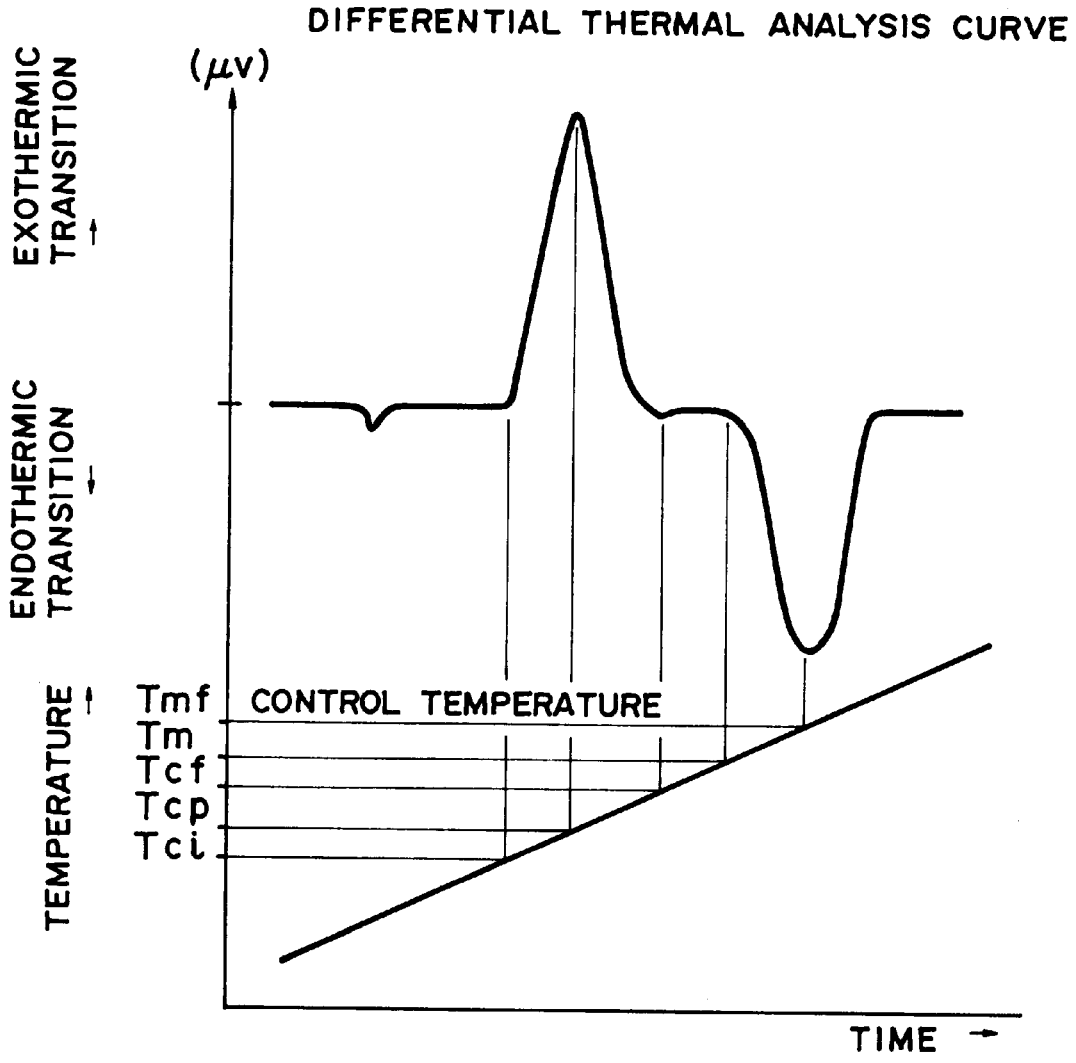
FIG. 12 is a graph showing a differential thermal analysis curve of a selenium-tellurium alloy with a tellurium content of 8 wt. % measured by a commercially available differential thermal analyzer (Trademark "DT-30B" made by Shimadzu Corporation) with a temperature elevation rate of 10° C./min.

The results are as shown in FIG. 12. In FIG. 12, Tci indicates the crystallization initiation temperature of the selenium-tellurium alloy, which was 131° C.; Tcp, the crystallization peak temperature thereof, which was 168° C.; Tcf, the crystallization finalization temperature thereof at which the crystallization was finalized, which was 185° C.; Tm, the melting point thereof, which was 219° C.; and Tmf, the temperature at which the endothermic transition was finalized, which was 253° C.

The graph in FIG. 12 indicates that exothermic heat which was generated from the crystallization initiation at Tci through the crystallization finalization at Tcf was used for shortening the warm up of the surface of each image fixing roller of the present invention.

Relationship Between the Number of Crystal Nuclei per Unit Volume of a SeTe Alloy Serving as an Exothermic Phase Transition Material and the Concentration of Te in the SeTe Alloy Reference Example 1

SeTe alloys with the concentrations of Te being 3, 5, 10, 15, 20, 25, 30, 35, 40 and 50 wt. % were respectively prepared by melting selenium with high purity (99.999%) and tellurium in the respectively corresponding amounts.

Each of the SeTe alloys was heated by use of the previously mentioned differential thermal analyzer with a temperature elevation rate of 10° C./min until the crystallization thereof was completely finalized with reference to each differential thermal analysis curve, for example, as shown in FIG. 12.

Each of the thus crystallized SeTe alloys was then subjected to a cleavage analysis and the number of spherical crystallites observed per unit area of a cross section thereof was counted by a scanning electron microscope (SEM). With the thus counted number of the crystallites per unit area of the cross section of the SeTe alloy being regarded as the number of crystal nuclei before the formation of the crystallites, the number of crystal nuclei per unit volume of the SeTe alloy serving as an exothermic phase transition material was determined.

Figure 13:
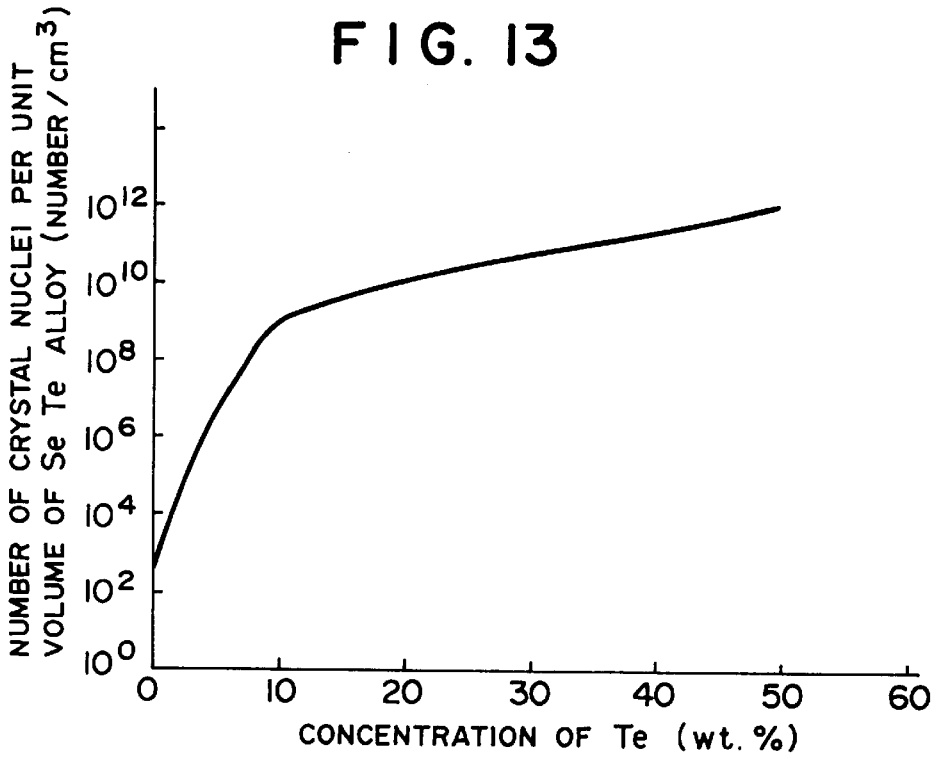
FIG. 13 is a graph showing the relationship between the number of crystal nuclei per unit volume of the SeTe alloy serving as an exothermic phase transition material and the concentration of Te in the SeTe alloy.

FIG. 13 shows the relationship between the number of crystal nuclei per unit volume of the SeTe alloy serving as an exothermic phase transition material and the concentration of Te in the SeTe alloy.

Figure 14:
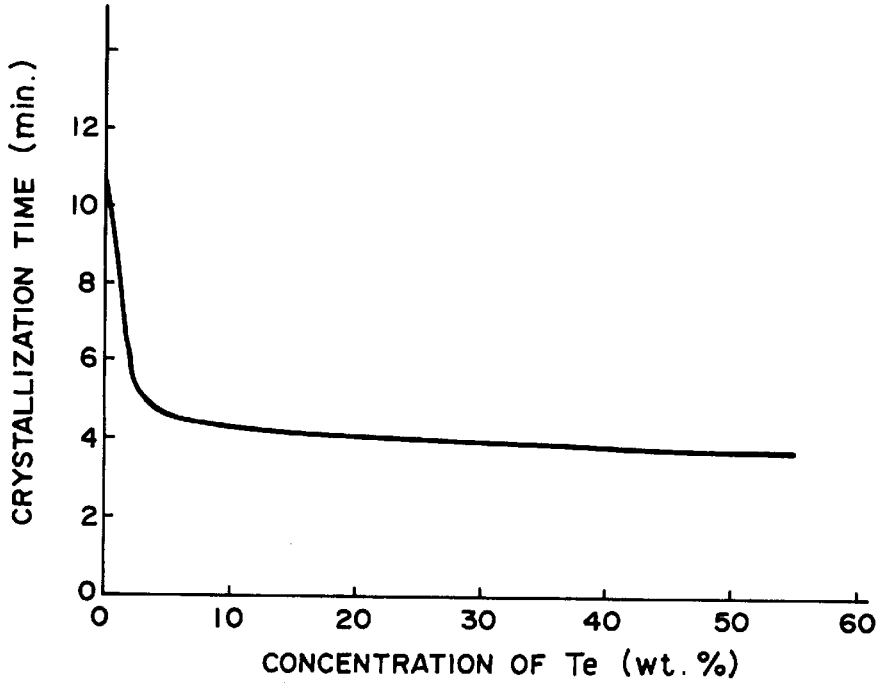
FIG. 14 is a graph showing the relationship between the crystallization time of the SeTe alloy as shown in FIG. 13 and the concentration of Te in the SeTe alloy.

FIG. 14 shows the relationship between the crystallization time of the SeTe alloy shown in FIG. 13 and the concentration of Te in the SeTe alloy.

FIG. 14 indicates that when the concentration of Te is 5 wt. % or more, the crystallization time, that is, a time period from the initiation of the crystallization through the termination thereof, is sufficiently short for use in practice.

With reference to FIG. 13, the concentration of Te as being 5 wt. % or more corresponds to the number of crystal nuclei in the SeTe alloy, with which the sufficiently short crystallization time can be obtained.

Reference Example 2

Selenium solid solutions, with the amounts of dissolved oxygen therein being 0.1, 0.5, 1.0, 5.0, 10.0, 50.0, 100, 500, 1000 ppm and a not detective amount of less than 0.01 ppm, were prepared by melting a mixture of the respectively corresponding amounts of $SeO_2$and selenium with high purity (99.999%) with application of heat thereto.

Each of the solid solutions was heated by use of the previously mentioned differential thermal analyzer with a temperature elevation rate of 10° C./min until the crystallization thereof was completely finalized with reference to each differential thermal analysis curve, for instance, as shown in FIG. 12.

Each of the thus crystallized solid solutions was then subjected to a cleavage analysis and the number of spherical crystallites observed per unit area of a cross section thereof was counted by a scanning electron microscope (SEM). With the thus counted number of the crystallites per unit area of the cross section of the solid solution being regarded as the number of crystal nuclei before the formation of the crystallites, the number of crystal nuclei per unit volume of the solid solution serving as an exothermic phase transition material was determined.

Figure 15:
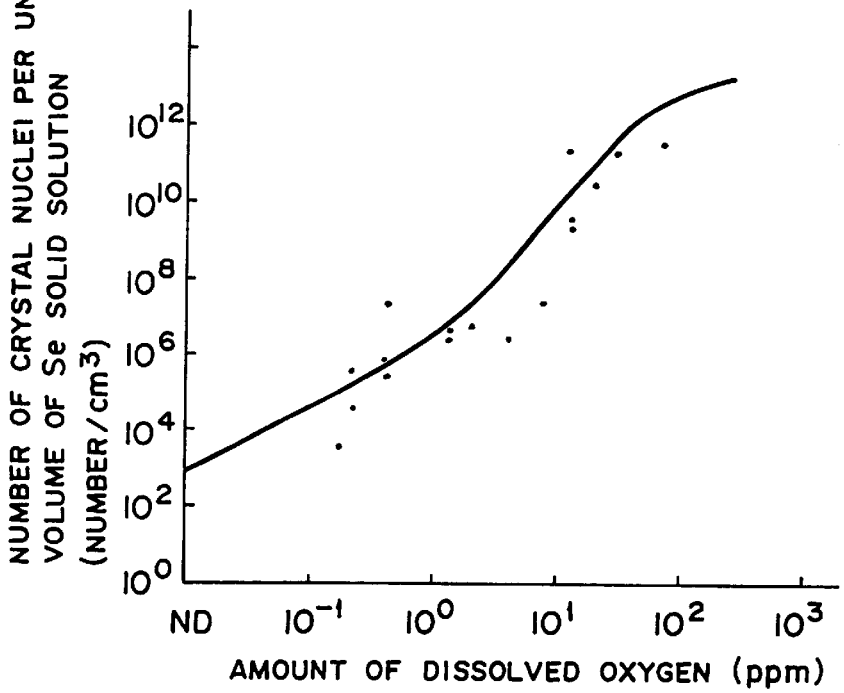
FIG. 15 is a graph showing the relationship between the number of crystal nuclei per unit volume of a Se solid solution serving as an exothermic phase transition material and the amount of dissolved oxygen in the Se solid solution.

FIG. 15 shows the relationship between the number of crystal nuclei per unit volume of the solid solution serving as an exothermic phase transition material and the amount of dissolved oxygen in the solid solution.

Figure 16:
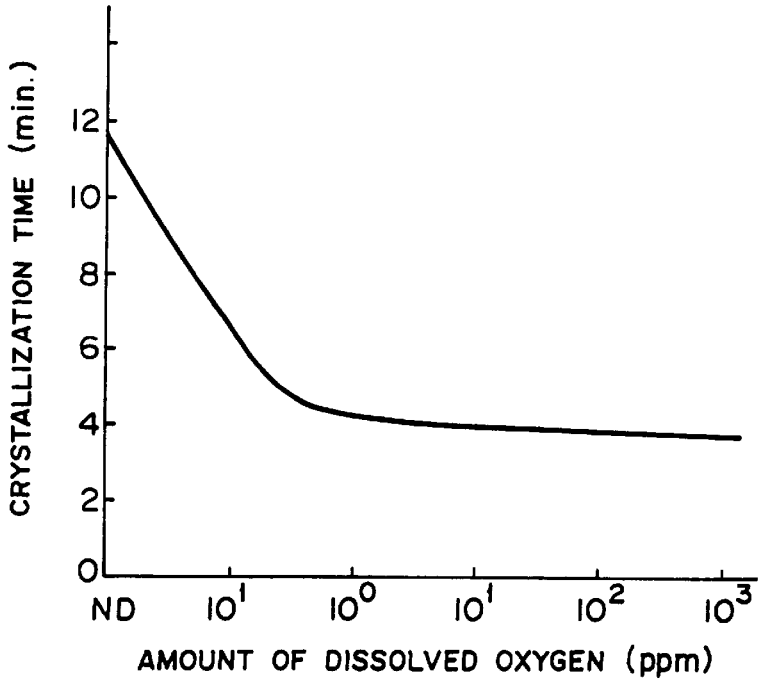
FIG. 16 is a graph showing the relationship between the crystallization time of the Se solid solution shown in FIG. 15 and the amount of dissolved oxygen in the Se solid solution.

FIG. 16 shows the relationship between the crystallization time of the solid solution shown in FIG. 15 and the amount of dissolved oxygen in the solid solution.

FIG. 16 indicates that when the amount of dissolved oxygen in the solid solution is 1 ppm or more, the crystallization time is sufficiently short for use in practice.

With reference to FIG. 15, the amount of dissolved oxygen in the solid solution being 1 ppm or more corresponds to the number of crystal nuclei in the Se solid solution, with which the sufficiently short crystallization time can be obtained.

Japanese Patent Applications Nos. 07-116286 and 07-116288 Apr. 18, 1995, Japenese Patent Application No. 07-144130filed May 18, 1995, Japenese Patent Application No. 07-157282 filed Jun. 23, 1995 and Japanese Patent Application No. 07-281315 filed Oct. 30,1995 are incorporated by reference.

What is claimed is:

1. An image fixing apparatus for thermally fixing images on an image receiving material at a predetermined image fixing temperature, comprising:

an image fixing device comprising a core member, and an exothermic phase transition layer provided on said core member, comprising an exothermic phase transition material which is capable of performing reversible phase transition from an amorphous solid state to a crystalline state with liberation of crystallization heat therefrom, and vice versa, and has a melting point higher than said predetermined image fixing temperature, a heating device which maintains the temperature of at least an outer surface of said image fixing device at said predetermined image fixing temperature, a first phase transition device which heats said exothermic phase transition layer, thereby having said exothermic phase transition material perform phase transition from said amorphous state to said crystalline state for liberation of crystallization heat therefrom, a second phase transition device which has said exothermic phase transition material perform phase transition from said crystalline state to said amorphous solid state, and a pressure application device which rotates in pressure contact with the outer surface of said image fixing device with the application of a predetermined pressure thereto.

2. The image fixing apparatus as claimed in claim 1, wherein said second phase transition device comprises:

1) a melting member which melts said exothermic phase transition material in said crystalline state to change the state thereof to a melted state, and 2) a cooling member which cools said exothermic phase transition material in said melted state to perform phase transition of said exothermic phase transition material from said melted state to said amorphous solid state.

3. The image fixing apparatus as claimed in claim 2, wherein said image fixing device comprises a protective layer which is provided on said exothermic phase transition layer so as to cover an outer surface of exothermic phase transition layer in its entirety, and has a melting point higher than that of said exothermic phase transition material.

4. The image fixing apparatus as claimed in claim 1, wherein said core member is roller-shaped, and said second phase transition device comprises (1) a melting member which melts said exothermic phase transition material in said crystalline state to change the state thereof to a melted state, and (2) a rotation control member which rotates said roller-shaped core member, thereby cooling said exothermic phase transition material in said melted state to cause said exothermic phase transition material to return to said amorphous solid state.

5. An image fixing apparatus for thermally fixing images on an image receiving material at a predetermined image fixing temperature, comprising:

an image fixing device comprising a core member and an exothermic phase transition layer provided on said core member, comprising an exothermic phase transition material which is capable of performing reversible phase transition from an amorphous solid state to a crystalline state with liberation of crystallization heat therefrom, and vice versa, and has a melting point higher than said predetermined image fixing temperature, and a heating control device which (a) heats said exothermic phase transition material in said amorphous state to a crystallization initiation temperature of said exothermic phase transition material, (b) maintains the temperature of an outer surface of image fixing device at said predetermined image fixing temperature, and (c) has said exothermic phase transition material perform phase transition front said crystalline state to said amorphous solid state.

6. An image fixing method for thermally fixing images on an image receiving material at a predetermined image fixing temperature, using an image fixing device which comprises a core member and an exothermic phase transition layer provided on said core member, comprising an exothermic phase transition material which is capable of performing reversible phase transition from an amorphous solid state to a crystalline state with liberation of crystallization heat therefrom, and vice versa, and has a melting point higher than said predetermined image fixing temperature, comprising the steps of:

a heating step in which said exothermic phase transition material is heated to have said exothermic phase transition material perform phase transition from said amorphous solid state to said crystalline state for liberation of crystallization heat therefrom, an image fixing step in which images are thermally fixed on said image receiving material with at least an outer surface of said image fixing device being maintained at said predetermined image fixing temperature, and a return step in which the state of said exothermic phase transition material in said crystalline state is returned to said amorphous solid state.

7. The image fixing method as claimed in claim 6, wherein said return step comprises:

a melting step in which said exothermic phase transition material in said crystalline state is melted to change the state thereof to a melted state, and a cooling step in which said exothermic phase transition material in said melted state is cooled to change the state thereof to said amorphous solid state.

8. An image fixing apparatus for thermally fixing images on an image receiving material at a predetermined image fixing temperature, comprising:

temperature elevation acceleration means comprising a material capable of performing phase transition from an amorphous solid state to a crystalline state with liberation of crystallization heat therefrom, and vice versa, said temperature elevation acceleration means comprising (a) first phase transition operation means for having said material perform phase transition from said amorphous solid state to said crystalline state for liberation of crystallization heat therefrom, and (b) second phase transition operation means for having said phase transition material in said crystalline state perform phase transition to return to said amorphous solid state.

9. The image fixing apparatus as claimed in claim 8, wherein said second phase transition operation means comprises:

melting means for melting said phase transition material in said crystalline state to change the state thereof to a melted state, and cooling means for cooling said phase transition material in said melted state to cool and solidify said phase transition material.

10. An image fixing roller for thermally fixing an image forming material on an image holding member at a predetermined image fixing temperature, comprising:

a core member, and an exothermic phase transition layer provided on said core member, comprising an exothermic phase transition material which is capable of performing reversible phase transition from an amorphous solid state to a crystalline state and vice versa and has a melting point higher than said predetermined image fixing temperature.

11. The image fixing roller as claimed in claim 10, wherein said exothermic phase transition material comprises at least one component selected from the group consisting of chalcogen and chalogenide.

12. The image fixing roller as claimed in claim 10, wherein said exothermic phase transition layer further comprises an exothermic polymer which performs reversible phase transition from an amorphous solid state to a crystalline state, and vice versa, with liberation of crystallization heat therefrom at a crystallization temperature thereof which is lower than said predetermined image fixing temperature.

13. The image fixing roller as claimed in claim 10, wherein said exothermic phase transition material comprises a chalcogen and at least one element selected from the group of the elements of IIIA to VIB of the Periodic Table other than chalcogen, and the number of crystalline nuclei per unit volume of said exothermic phase transition material is $10^6/cm^3$ or more.

14. An image fixing apparatus for fixing a toner image transferred to an image transfer sheet thereto, at a predetermined image fixing temperature, at a nip between an image fixing roller and a pressure application roller which are rotated in pressure contact with each other, comprising:

a rotating member which rotates at least said image fixing roller, said image fixing roller comprising a core roller, an exothermic phase transition layer, and a protective layer, said core roller being a hollow cylindrical roller provided with a concave portion extending in a circumferential direction of said core roller on an outer peripheral surface thereof, said concave portion being provided with an outer peripheral portion at each of opposite sides thereof, said exothermic phase transition layer being disposed within said concave portion and comprising an exothermic phase transition material which is capable of performing reversible phase transition from an amorphous solid state to a crystalline state and vice versa, with liberation of crystallization heat therefrom by the crystallization thereof, and has a melting point higher than said predetermined image fixing temperature, said protective layer being provided on said exothermic phase transition layer so as to cover said exothermic phase transition layer and being in contact with an outer surface of said core roller, and having a melting point higher than the melting point of said exothermic phase transition material, a heater which is built in a hollow portion of said core roller and is capable of maintaining at least the outer surface of said image fixing roller at said predetermined image fixing temperature and also is capable of heating said exothermic phase transition material, thereby having said exothermic phase transition material perform reversible phase transition from an amorphous solid state to a crystalline state, with liberation of crystallization heat therefrom by the crystallization thereof, and also is capable of melting said exothermic phase transition material in said crystalline state to change the state thereof to a melted state, and a cooling fan which cools said exothermic phase transition material in said fused state so as to return the state thereof to said amorphous state.

15. The image fixing apparatus as claimed in claim 14, wherein said air fan sends air towards said nip at which said image fixing roller and said pressure application roller are in contact with each other.

16. The image fixing apparatus as claimed in claim 14, further comprising a pressure application member which brings the outer surface of said pressure application roller into pressure contact with the outer surface of said image fixing roller, and a release member which releases said pressure application member from the state in which said pressure application member is in pressure contact with the outer surface of said image fixing roller when said exothermic phase transition material is being cooled by said cooling fan.

17. The image fixing apparatus as claimed in claim 14, further comprising a control member which controls said rotating member so as to rotate said image fixing roller when said exothermic phase transition material is being cooled by said cooling fan.

18. An image fixing roller for fixing a toner image transferred to an image transferred sheet thereto, at a predetermined image fixing temperature, comprising:

a core roller, an exothermic phase transition layer, and a protective layer, said core roller comprising a concave portion extending along an outer peripheral surface thereof in a circumferential direction thereof, provided with an outer peripheral portion at each of opposite sides thereof, said exothermic phase transition layer being disposed within said concave portion and composing an exothermic phase transition material which is capable of performing reversible phase transition from an amorphous solid state to a crystalline state and vice versa, and has a melting point higher than said predetermined image fixing temperature, said protective layer being provided on said exothermic phase transition layer so as to cover said exothermic phase transition layer and being in contact with an outer surface of said core roller, and having a melting point higher than the melting point of said exothermic phase transition material.

19. An image fixing roller for fixing a toner image transferred to an image transferred sheet thereto, at a predetermined image fixing temperature, comprising, a core roller, a resistive heater, an exothermic phase transition layer, and a protective layer, said resistive heater being provided on said core roller, said exothermic phase transition layer being provided on said resistive heater and comprising an exothermic phase transition material which is capable of performing reversible phase transition from an amorphous solid state to a crystalline state and vice versa, and has a melting point higher than said predetermined image fixing temperature, and said protective layer being provided on said exothermic phase transition layer so as to cover said exothermic phase transition layer and being in contact with an outer surface of said core roller, and having a melting point higher than the melting point of said exothermic phase transition material.

20. An image fixing roller for fixing a toner image transferred to an image transferred sheet thereto, at a predetermined image fixing temperature, comprising:

a core roller, a heating layer, an insulating layer, an exothermic phase transition layer, and a protective layer, said heating layer being provided on said core roller, said insulating layer being provided on said heating layer, said exothermic phase transition layer being provided on said resistive heater and comprising an exothermic phase transition material which is capable of performing reversible phase transition from an amorphous solid state to a crystalline state and vice versa, and has a melting point higher than said predetermined image fixing temperature, and said protective layer being provided on said exothermic phase transition layer so as to cover said exothermic phase transition layer and being in contact with an outer surface of said core roller, and having a melting point higher than the melting point of said exothermic phase transition material.

21. The image fixing roller as claimed in claim 20, further comprising a second insulating layer which is interposed between an outer surface of said core roller and said exothermic layer.

* * * * *

UNITED STATES PATENT AND TRADEMARK OFFICE

CERTIFICATE OF CORRECTION

PATENT NO. : 5,987,295

DATED : November 16, 1999

INVENTOR(S) : Minoru Matsuo et al

It is certified that error appears in the above-identified patent and that said Letters Patent is hereby corrected as shown below:

On the title page, please insert:

--Related U.S. Application Data

Continuation of application No. 08/633,312, April 17, 1996, Pat. No. 5,804,794.

Foreign Application Priority Data

| | | | |
|---|---|---|---|
| Apr. 18, 1995 | [JP] | Japan | 7-116286 |
| Apr. 18, 1995 | [JP] | Japan | 7-116288 |
| May 18, 1995 | [JP] | Japan | 7-144130 |
| Jun. 23, 1995 | [JP] | Japan | 7-157282 |
| Oct. 30, 1995 | [JP] | Japan | 7-281315-- |

Signed and Sealed this

Twenty-eighth Day of November, 2000

*Attest:*

*Attesting Officer*

Q. TODD DICKINSON

*Director of Patents and Trademarks*

UNITED STATES PATENT AND TRADEMARK OFFICE

CERTIFICATE OF CORRECTION

PATENT NO. : 5,987,295

DATED : November 16, 1999

INVENTOR(S) : Minoru MATSUO, ET AL.

It is certified that error appears in the above-identified patent and that said Letters Patent is hereby corrected as shown below:

Column 2, line 7, "worm-up" should read --warm-up--.

Column 9, line 27, delete Si-Ge-As- Te.

Column 13, line 58, "cites" should read --sites--.

Column 14, line 1, "sate" should read --state--.

Column 18, line 27, "07-144130filed" should read --07-144130 filed--.

Column 19, line 38, "front" should read --from--.

Signed and Sealed this

Twenty-eighth Day of November, 2000

*Attest:*

*Attesting Officer*

Q. TODD DICKINSON

*Director of Patents and Trademarks*